US006997410B1

(12) United States Patent
Huang

(10) Patent No.: US 6,997,410 B1
(45) Date of Patent: Feb. 14, 2006

(54) POSITIONING DEVICE FOR A REEL

(76) Inventor: Kui-Hsien Huang, PO Box 82-144, Taipei (TW)

( * ) Notice: Subject to any disclaimer, the term of this patent is extended or adjusted under 35 U.S.C. 154(b) by 0 days.

(21) Appl. No.: 10/935,153

(22) Filed: Sep. 8, 2004

(51) Int. Cl.
*B65H 75/48* (2006.01)

(52) U.S. Cl. ..... 242/378.3; 242/385.4; 191/12.2 R

(58) Field of Classification Search ..... 242/378, 242/378.1, 378.2, 378.3, 385, 385.4; 191/12.2 R, 191/12.2 A, 12.4

See application file for complete search history.

(56) References Cited

U.S. PATENT DOCUMENTS

| | | | | | |
|---|---|---|---|---|---|
| 996,476 | A * | 6/1911 | Filton et al. | ..... | 242/385.4 |
| 1,945,842 | A * | 2/1934 | Witchger | ..... | 242/385.4 |
| 2,129,582 | A * | 9/1938 | Anders | ..... | 242/385.4 |
| 5,014,437 | A * | 5/1991 | Sun | ..... | 242/385.4 |
| 5,178,619 | A * | 1/1993 | Galazaka | ..... | 242/385.4 |
| 6,199,784 | B1 * | 3/2001 | Wang et al. | ..... | 242/378 |
| 6,378,797 | B1 * | 4/2002 | Liao | ..... | 242/378.1 |

* cited by examiner

*Primary Examiner*—William A. Rivera
(74) *Attorney, Agent, or Firm*—Leong C. Lei

(57) ABSTRACT

A positioning device for a reel is disclosed. The positioning device contains a spring-loaded reeling disc, wherein when the cable or wire is pulled to rotate for a half round, a positioning mechanism is made. A button is used to control either a single step or multiple steps retraction of the cable or wire.

2 Claims, 7 Drawing Sheets

POSITIONING DEVICE FOR A REEL

BACKGROUND OF THE INVENTION (a) Technical Field of the Invention

The present invention relates to a reel for cable-reeling or wire-reeling, and in particular to a positioning device for a reel. The reel allows cable or wire to be retracted to the reel neatly.

(b) Description of the Prior Art

FIGS. 1 and 2 show a conventional reel A10 comprising a front cover A1, a rotating spring A2, a sliding seat A3, a transmission wire A4, a positioning bead A5 and a rear cover A6. The rotating spring retracts the transmission wire A4 and a positioning mechanism employing the steel bead A5 to position the wire A4. A steel bead rail A31 is provided to allow the movement of the steel bead A5. The conventional structure requires very precise dimension and therefore fabrication of a mold for such structure is difficult, and the cost of fabrication is high. Further, the wear of the rail A31 or the big gap formed on the rail A31 will cause a failure in positioning. Therefore, the conventional reel A10 is frequently dislocated or cannot be positioned. In addition, the steel bead used for positioning will not allow step by step retraction of the wire, the positioning of the wire is not accurate and only one round is made, otherwise positioning is not possible. This will cause either the cable is too long or too short.

Accordingly, it is an object of the preset invention to provide a positioning device for a reel which mitigates the above drawbacks.

SUMMARY OF THE INVENTION

An object of the present invention is to provide a positioning device for a reel operated with button comprising a top cover, a press button, a partition plate, a reel plate, a wire, a rotating spring and a bottom cover, wherein the top cover is provided at a center hole having a bottom inner edge provided with a first stepped level and a second stepped level, the first stepped level has an engaging slot for the mounting of the press button and the positioning of the engaging wings, and the second stepped level is for the insertion of the partition plate for securing; the press button is positioned within the first stepped level and is at the engaging slot of the first stepped level, and the bottom section of the press button has a corresponding spring having a gap with the partition plate, and the external edge of the bottom section has a pressing peg corresponding to the through slot at the lower section of the partition plate; the partition plate is positioned within the second stepped level and has a bottom face with a center for the position of the center shaft of the bottom cover, and the external edge has a through slot with a top section corresponding to the press peg of the press key and the bottom section is for the engagement of the spring-loaded peg, and therefore one side of the through slot is a slanting face, and the other side is a vertical face; a rotating plate has a clip plate or clip mouth and the inner bottom of the external edge is a spring loaded-peg slot for mounting of a peg, a spring and a sealing plate, and the peg has a slanting face at the corner corresponding to the slanting face at one side of the peg slot of the partition plate; the wire rotates along the outer edge of the rotating plate and is divided into a top position and a bottom position, the rotating spring having a center end is connected to the engaging slot at the center shaft of the inner section of the bottom cover and is secured, the external end is hooked to the engaging slot of the rotating plate, and the bottom cover matches the top cover and the center shaft is provided with an engaging slot for the insertion of the center end of the rotating spring.

Yet a further object of the present invention is to provide a positioning device for a reel, wherein the wire or cable can be fully retracted to the reel.

Still another object of the present invention is to provide a positioning device for a reel, wherein appropriate length after pulled or retracted could be secured precisely.

Another object of the present invention is to provide a positioning device for a reel, wherein the pulling or retraction of the wire or cable is precise.

Yet another object of the present invention is to provide a positioning device for a reel, wherein the pulling or retraction of wire/or cable is quick and simple and the wire or cable can be pulled or retracted in one step or in multiple steps.

Still a further object of the present invention is to provide a positioning device for a reel, wherein the assembly can be easily and quickly installed.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
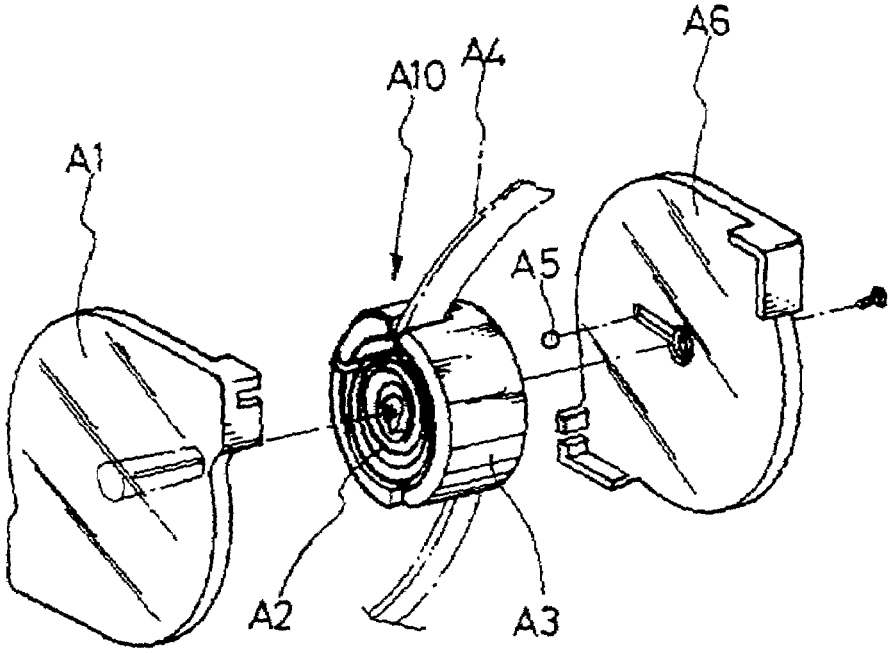
PRIOR ART FIG. 1
FIG. 1 is an exploded perspective view of a conventional reel employing steel bead for positioning.
Figure 2:
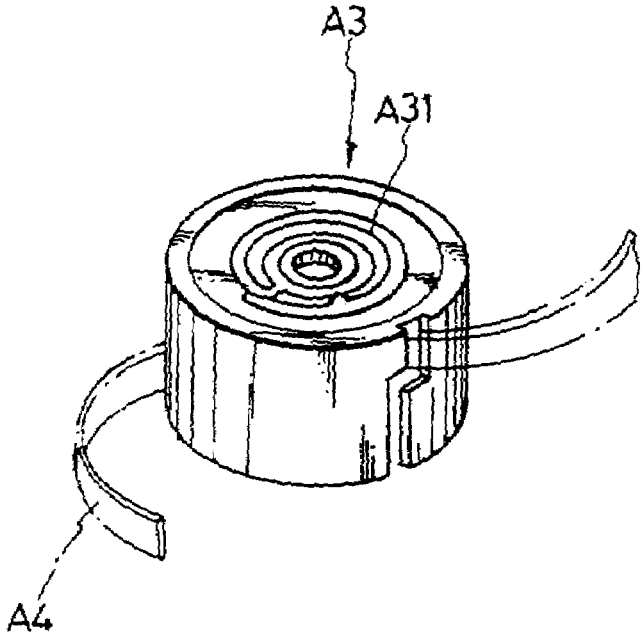
PRIOR ART FIG. 2
FIG. 2 is a perspective view of the bottom section of the sliding seat of the conventional reel.
Figure 3:
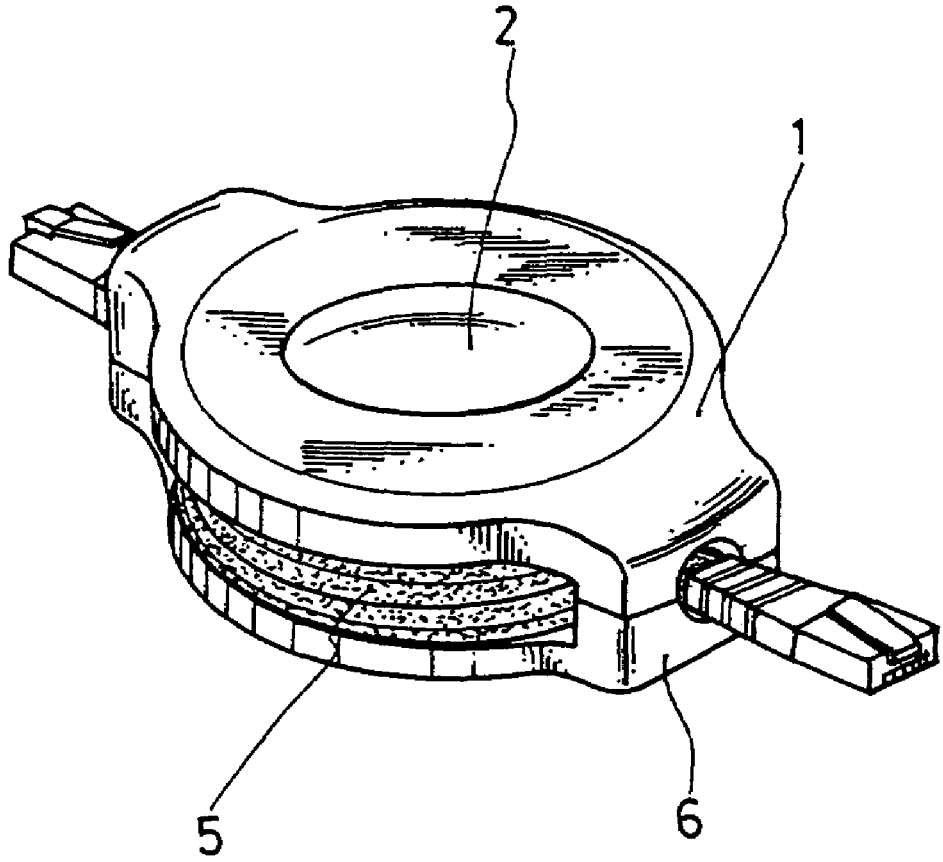
FIG. 3 is a perspective view of the preferred embodiment in accordance with the present invention.
Figure 4:
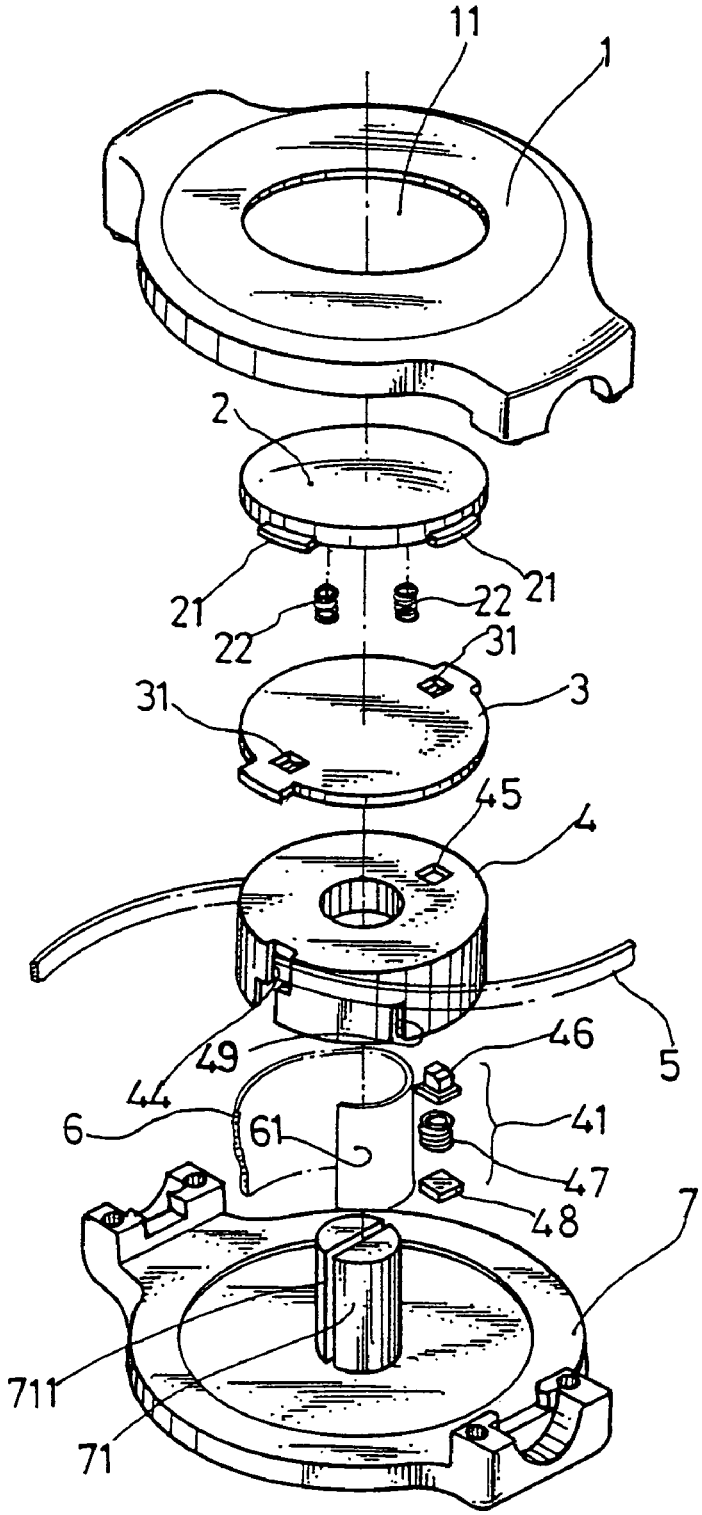
FIG. 4 is an exploded view of the reel showing the individual components.
Figure 5:
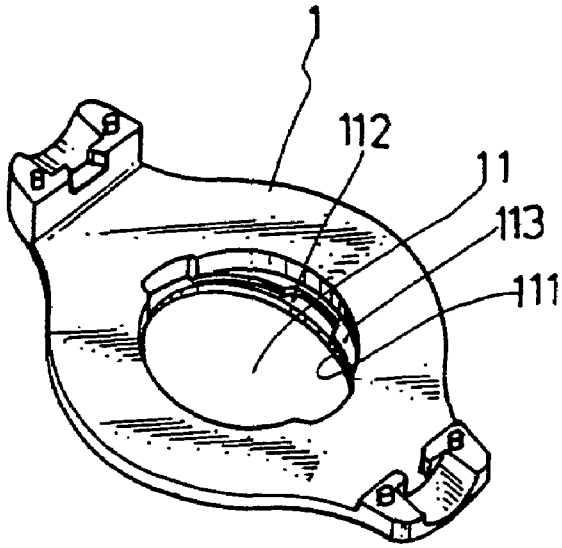
FIG. 5 is a schematic view showing the bottom section of the top cover of the present invention.
Figure 10:
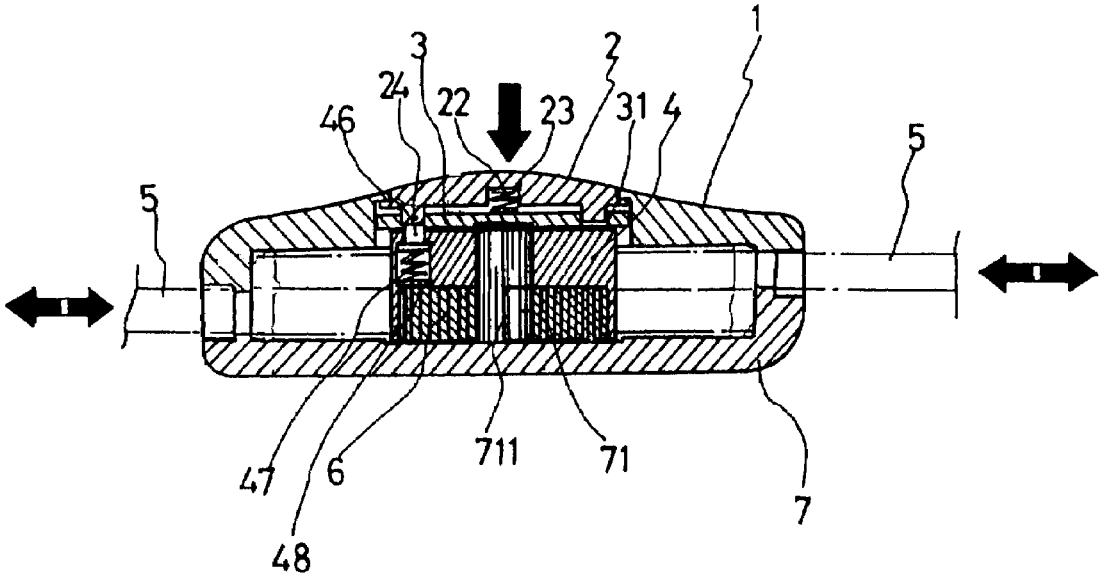
FIG. 10 is a schematic view showing the operation of the reel in accordance with the present invention.

Referring to FIGS. 3 and 4, the positioning device for a reel operated with button comprising a top cover 1, a press button 2, a partition plate 3, a rotating plate 4, a wire 5, a rotating spring 6 and a bottom cover 7, wherein the top cover 1 is provided with a center hole 11 similar to the press button 2 for the mounting of the press button 2. As shown in FIG. 5, the bottom inner edge of the center hole 11 is provided with the first level 111 and a second stepped level 113. The first stepped level 111 has an engaging slot 112 for the mounting of the press button 2 and the positioning of the engaging wings 21, and the second stepped level 113 is for the insertion of the partition plate 3 for securing. Thus, bottom edge of the press button 2 and the partition plate 3 form a narrow gap by means of a spring 22, which is the distance the button 2 is depressed, as shown in FIG. 10. The press button 2 is positioned within the first stepped level 111 and is at the engaging slot of the first stepped level 111, and the bottom section of the press button 2 has a corresponding spring having a gap with the partition plate, and the external edge of the bottom section has a pressing peg 24 corresponding to the through slot 31 at the lower section of the partition plate 3 as shown in FIGS. 6 and 10.

Figure 6:
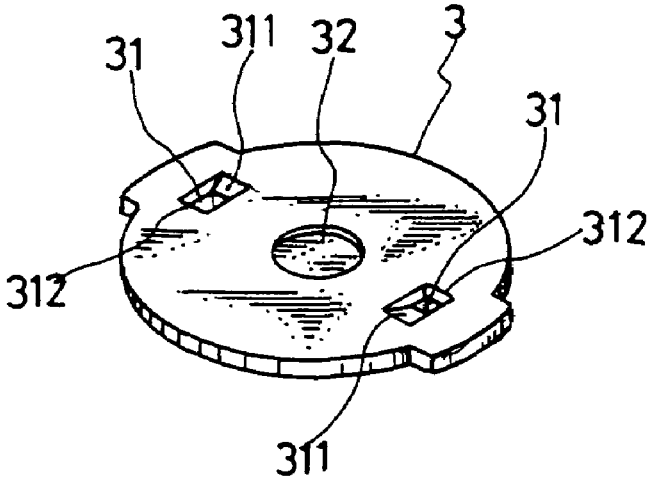
FIG. 6 is a schematic view showing the bottom section of the partition plate of the present invention.
Figure 7:
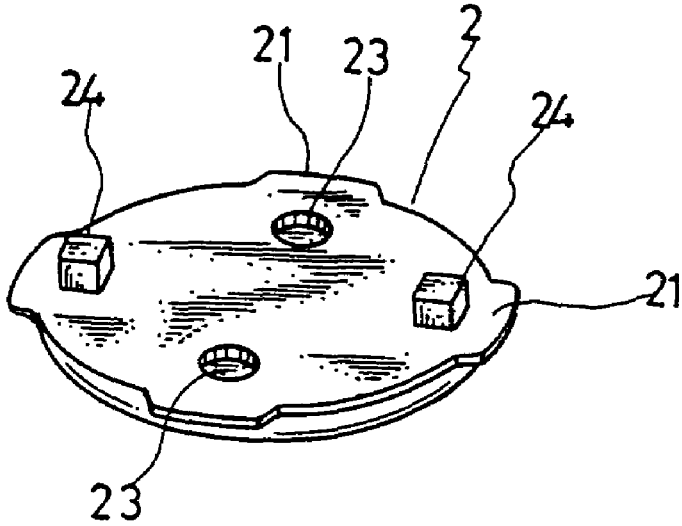
FIG. 7 is a schematic view showing the bottom section of the button of the present invention.
Figure 8:
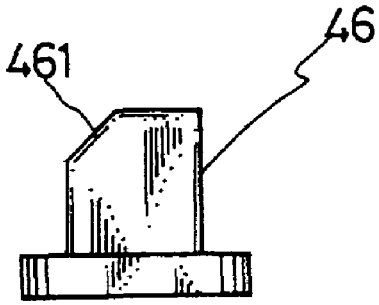
FIG. 8 is a schematic view showing the flat structure of the peg in accordance with the present invention.
Figure 9:
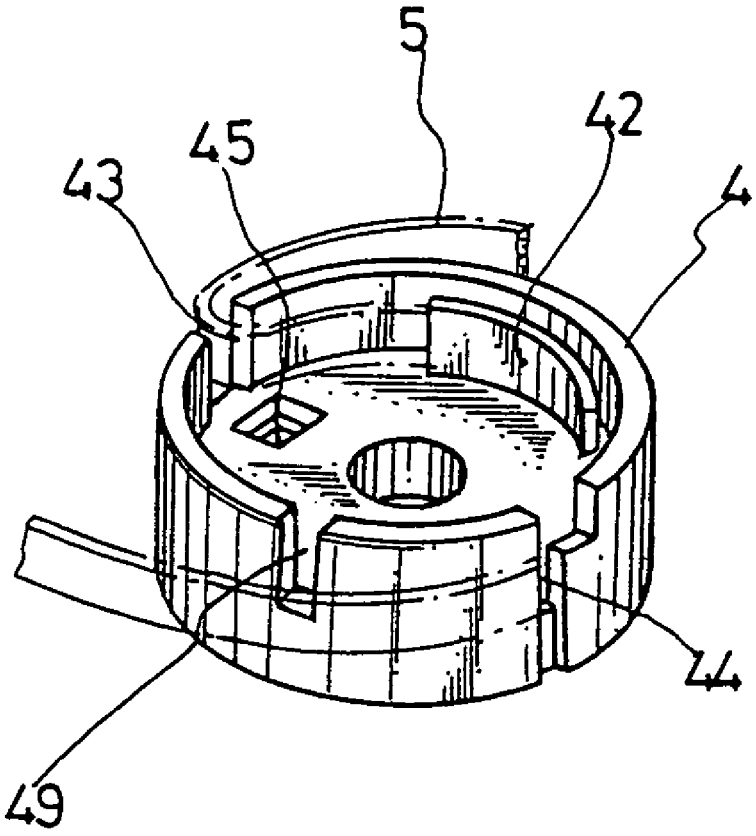
FIG. 9 is a schematic view showing the bottom structure of the reel of the present invention.

As shown in FIG. 6, the partition plate 3 has a positioning slot 32 for the center shaft 71 of the bottom cover 7 and the external edge has a through slot 31 with a top section corresponding to the press peg of the press key and the bottom section is for the engagement of the spring-loaded peg 41. One side of the through slot 31 has a slanting face 311, and the other side has a vertical face 312. The rotating plate 4, as shown in FIG. 9, has a clip plate or clip mouth 44 and the inner bottom of the external edge has a spring loaded-peg slot 45 for mounting of a peg 46, a spring 47 and a sealing plate 48. As shown in FIG. 8, the peg 46 has a slanting face 461 at the corner corresponding to the slanting face 461 at one side of the through slot 31 of the partition plate 3. The wire 5 rotates along the outer edge of the rotating plate 4 and is divided into a top position and a bottom position. The rotating spring 6, as shown in FIG. 4, has a center end connected to the engaging slot 711 at the center shaft 71 of the inner section of the bottom cover 7 and is secured. The external end is hooked to the engaging slot 49 of the rotating plate 4, and the bottom cover 7 matches the top cover 1 and the center shaft 71 is provided with an engaging slot 49 for the insertion of the center end of the rotating spring 6.

As shown in FIG. 10, when the wire 5 is to be pulled out from the reel of the present invention, the rotating plate 4 rotates and the spring-loaded peg 41 will pass through smoothly the slanting face 311 at one side of the peg 31. Thus, the wire 5 will be pulled out smoothly when the wire 5 is to be retracted, the button 2 is depressed, the press peg 24 passes through the peg slot 31 and the spring-load peg 41 is depressed, and the rotating plate 4 rotates by means of the spring. Thus, the button 2 is used to provide a single retraction or multiple retractions.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A positioning device for a reel comprising a top cover, a press button, a partition plate, a rotating plate, a wire, a rotating spring and a bottom cover, wherein the top cover is provided with a center hole having a bottom inner edge provided with a first stepped level and a second stepped level, the first stepped level has an engaging slot for mounting of the press button and positioning of engaging wings of the press button, and the second stepped level is for insertion of the partition plate for securing; the press button is positioned within the first stepped level and is at the engaging slot of the first stepped level, and a bottom section of the press button has a corresponding spring having a gap with the partition plate, an external edge of the bottom section has a pressing peg corresponding to a through slot at a lower section of the partition plate; the partition plate is positioned within the second stepped level and has a bottom face with a center for positioning of a center shaft of the bottom cover, an external edge of the partition plate has a through slot and a bottom section for engagement of a spring-loaded peg, one side of the through slot has a slanting face, another side of the through slot has a vertical face; the rotating plate has a clip mouth, an inner bottom of an external edge of the rotating plate has a spring loaded-peg slot for mounting of the spring-loaded peg which includes a peg, a spring and a sealing plate, the peg has a slanting face at a corner corresponding to the slanting face at one side of the through slot of the partition plate; the wire rotates along an outer edge of the rotating plate and is divided into a top position and a bottom position; the rotating spring has a center end secured to an engaging slot of the center shaft, an external end of the rotating spring is hooked to an engaging slot of the rotating plate; and the bottom cover matches the top cover.

2. The positioning device for a reel of claim 1, wherein the through slot of the partition plate is provided at two opposite sides of the partition plate.

* * * * *